US006838138B1

(12) United States Patent
Akiyama et al.

(10) Patent No.: US 6,838,138 B1
(45) Date of Patent: Jan. 4, 2005

(54) SYNTHETIC RESIN CONTAINER BEARING LABEL

(75) Inventors: Yoshio Akiyama, Tochigi (JP); Shuichi Koshio, Matsudo (JP); Masashi Yoneyama, Matsudo (JP); Hiroaki Tokuda, Koto-Ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 09/674,031

(22) PCT Filed: Feb. 28, 2000

(86) PCT No.: PCT/JP00/01143

§ 371 (c)(1),
(2), (4) Date: Oct. 25, 2000

(87) PCT Pub. No.: WO00/51901

PCT Pub. Date: Sep. 8, 2000

(30) Foreign Application Priority Data

Feb. 27, 1999 (JP) ..... 11-096727
Feb. 27, 1999 (JP) ..... 11-096728

(51) Int. Cl.[7] ..... B29D 22/00; B29D 23/00; B32B 1/08

(52) U.S. Cl. ..... 428/35.7; 428/34.1; 428/36.9; D9/550; D9/563; D9/574; 156/303.1; 156/500; 283/81; 40/306; 40/310; 220/669; 220/670; 220/671; 220/672; 220/673; 220/675; 206/443; 206/434; 206/587; 206/521.4

(58) Field of Search ..... 283/81; 220/669–673, 220/675; 40/306, 310; 428/35.7, 34.1, 36.5, 36.9; 156/303.1, 500; 264/509; D9/574, 550, 563

(56) References Cited

U.S. PATENT DOCUMENTS

| | | | | | |
|---|---|---|---|---|---|
| 1,554,191 | A | * | 9/1925 | Alexander | 40/310 |
| D177,275 | S | * | 3/1956 | Perinet | D9/550 |
| 3,207,822 | A | * | 9/1965 | Makowski | |
| 4,387,816 | A | * | 6/1983 | Weckman | 215/1 C |
| 4,662,528 | A | * | 5/1987 | Slat | 215/12 R |
| 4,802,295 | A | * | 2/1989 | Darr | 40/310 |
| 4,915,241 | A | * | 4/1990 | Morimura et al. | 215/398 |
| 5,079,057 | A | * | 1/1992 | Heider | 428/36.5 |
| 5,172,936 | A | * | 12/1992 | Sullivan et al. | 283/81 |
| 5,193,711 | A | * | 3/1993 | Hirata et al. | 220/62.11 |
| 5,968,443 | A | * | 10/1999 | Robles et al. | 264/509 |
| 6,223,945 | B1 | * | 5/2001 | Giblin et al. | 222/109 |

FOREIGN PATENT DOCUMENTS

| | | |
|---|---|---|
| JP | 1-96814 | 6/1989 |
| JP | 2-139327 | 5/1990 |
| JP | 2-184883 | 7/1990 |
| JP | 8-300456 | 11/1996 |

* cited by examiner

*Primary Examiner*—Harold Pyon
*Assistant Examiner*—Patricia L. Nordmeyer
(74) *Attorney, Agent, or Firm*—Oliff & Berridge, PLC

(57) ABSTRACT

It is an object of the present invention to prevent the edge of the in-molded label from the crack due to the impact of dropping the container, especially to prevent the occurrence of the crack on the thin synthetic resin container and to provide the synthetic resin container which a reinforce rib is disposed on the wall surface of the container body corresponding to the edge of the in-molded label to surround the label edge or to locate the label edge in said rib.

6 Claims, 15 Drawing Sheets

(a)

(b)

(a)

(b)

SYNTHETIC RESIN CONTAINER BEARING LABEL

FIELD OF THE INVENTION

The present invention relates to a synthetic resin container, especially to an in-molded synthetic resin container which a label is arranged on a blow molding die.

BACKGROUND OF THE INVENTION

For a method of arranging the label on the container surface, it has been practiced to arrange the label on the container surface by an in-mold.

However in case of the container which the label is arranged on the surface of the container by the in-mold, as illustrated by FIG. 6, at the time of molding, a portion 32 of a container wall 31 contacting with an edge 30 of a label Le used to be thin by a corner of the label, therefore due to the dropping impact, the problem that the crack occurs on the portion 32 contacting with the label edge.

Recently the reduce and the recycle of the plastic molding materials have been encouraged and it has been preferred to make the container thick for collecting to crush wasted containers, while in respect of the thin container, the portion 32 contacting with the label edge of the container wall has been formed to be thick more so that the problem of the occurrence of the crack thereon has been repeated.

It is an object of the present invention to prevent the occurrence of the crack on the in-mold label edge due to the impact of dropping the container, especially to prevent the occurrence of the crack on the thin container so as to provide a synthetic resin container which is arranged with in-molded label.

SUMMARY OF THE INVENTION

To achieve the objects of the present invention, in a synthetic resin container which is arranged with in-molded label on a body wall surface, on the body wall surface, the vertical rib is provided along the outside of the left and right edges of the label, having nothing to the size of the label, for reinforcing the thin portion of the label edge of the body wall surface, the lateral rib and the vertical rib are arranged to surround the outside of the label edge on upper and lower side of and left and right side of the body wall surface.

In a modified embodiment of the invention, the lateral rib and the vertical rib are arranged along the label edge on the body wall surface to locate the label edge within the rib groove.

Further the object of the present invention can be achieved by modifying the shape of the label so that the in-mold label which at least left and right edge is cut into the corrugate shape is applied and a plurality of concave portions are disposed along the left and right edges of the label with certain spaces in upper and lower direction to locate the label edge within the concave portion The object of the present invention described hereinbefore can be achieved by a blow molding to control the thickness of the container so as to form the thick portion on the body rear surface which contacts with the label edge.

PREFERRED EMBODIMENTS OF THE INVENTION

The first embodiment of the present invention will be described in conjunction with accompanied drawings.

Figure 1:
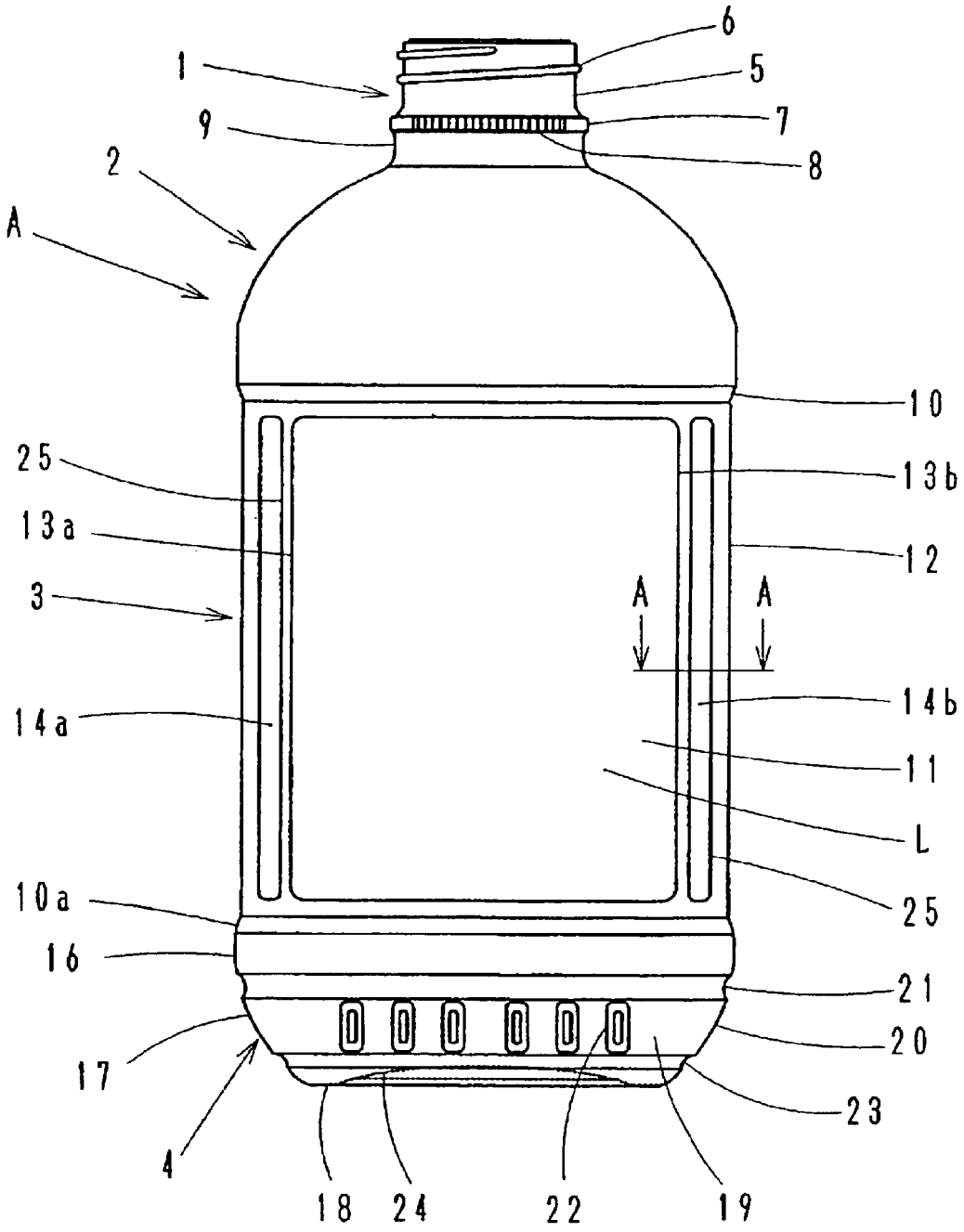
FIG. 1 is a front view of the synthetic resin container according to the first embodiment of the present invention.
Figure 2:
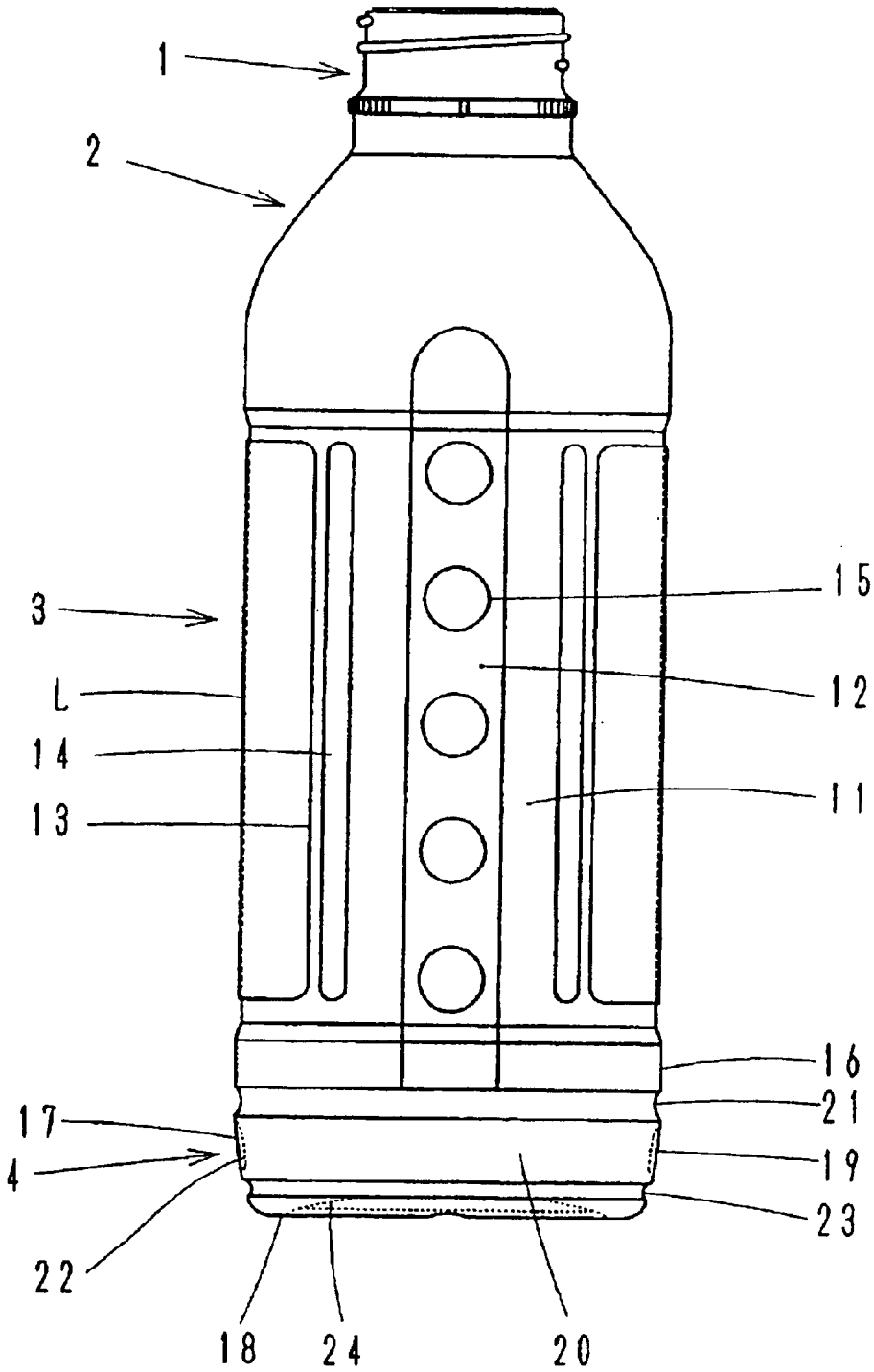
FIG. 2 is a side view of the container illustrated in FIG. 1.

In FIGS. 1 and 2, a container "A" comprises a neck 1, a shoulder 2, a body 3 and a bottom 4, and is made of synthetic resin such as polyethylene (PE), polypropylene (PP) and other synthetic resin which is blow molded in a single layer or a laminated layer.

A screw 6 is threaded on an outer peripheral surface of an upper portion 5 of the neck 1. A holder ring 7 is provided below the screw.

A knurl 8 is provided partially or full circumference of an outer peripheral surface of the ring 7. A lower cylindrical neck 9 below the ring 7 has a larger diameter than that of the upper cylindrical neck 5, and is connected to the shoulder 2.

A step 10 is formed between the shoulder 2 and the body 3. The shoulder 2 and the body 3 has a flattened cross section, which comprises elliptical front and rear surfaces of front and rear walls 11, and a planar side surfaces of left and right side walls 12.

Each of the front and rear walls 11 is provided with vertical ribs 14*a, b* along left and right edges 13*a, b* of a label "L". Each of the side walls 12 is provided with a plurality of concave portions which are arranged with equal intervals one another.

A protruded peripheral wall 16 is arranged at an lower end the body 3 through a step 10*a*, and is connected to the bottom 4.

The bottom 4 comprises a bottom peripheral wall 17 and a bottom wall 18. The wall 17 comprises substantially vertical front and rear walls 19 and an inclined left and right side walls 20.

A lateral rib 21 is circumferentially provided between the bottom peripheral wall 17 and the protruded peripheral wall 16. Each of the front and rear walls 19 is provided with a plurality of vertical ribs 22 which are arranged with equal intervals one another.

The bottom peripheral wall 17 is circumferentially provided with a lateral rib 23 at the lower end thereof. The rib 23 is connected to the bottom wall 18 having an upwardly depressed portion 24.

The container of the present invention is formed by well-known "label in-mold" method.

A die has an inner surface, which has protruded portions, which in turns will form the vertical ribs 14 of the container. First, the label "L" is arranged between the protruded portions, such that each of left and right edges 13*a*, 13*b* of the label "L" is arranged along each of the protruded portions. Then, a parison is extruded, hold by the dies, and is blow-molded by air, so as to form a container attached with the label.

The function and effect of the structure of the container according to embodiments of the present invention will be described.

Figure 3:
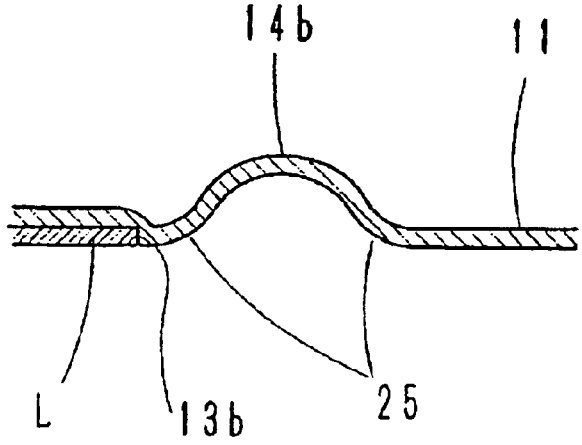
FIG. 3 is a cross section view of the vertical rib along line A—A of FIG. 1.

As illustrated in FIG. 3, each of the left and right edges 13*a* and 13*b* of the label L is disposed along and between the vertical ribs 14*a* and 14*b*.

Although the body wall portion contacting with the edge of the label is thinner than other parts of the container, when the container is dropped, since curved portions 25 arranged at both sides of the vertical rib 14 are deformed, an impact to the thin wall along the edges 13 of the label L is relieved, so as to prevent crack at edges of the label.

Each of the upper and lower edges of the label is arranged to be close to the upper and lower ends of the body. Thus, thin portion of the body wall along the upper and lower edges of the label is reinforced by the steps just above and below the body, so as to prevent crack at the upper and lower edge of the label.

If the container is made of PE or PP and if the body wall is formed to be thin about 0.6 mm, crack would occur at the edge of the label according to the conventional art. However, in such case, the present invention prevents the crack.

In case of the thin container, if the body wall at the center of the front or rear wall has a thickness about 0.3 mm or less, such container can be easily crushed to dispose it.

The step 10, the step 10*a* and the vertical rib 14 act as reinforcing member, respectively, so as to keep the shape of the container. In addition, they prevent crack of the container wall at edge of the label, even if the container is dropped.

If an easily-crushable thin wall container capable of keeping its shape or appearance is formed according to the present invention, such container can have a thin wall between just 0.1 mm and 0.3 mm, and such container can be formed in a range of just 0.05 to 0.015 g/ml (weight of the resin per volume of liquid content) of PP or PE.

Especially in case of a thin container, since the wall is thinner than the label, it is liable to occur crack. However, according to the present invention, crack does not occur at the edge of the label, because of the above described function and effect of the present invention.

Figure 4:
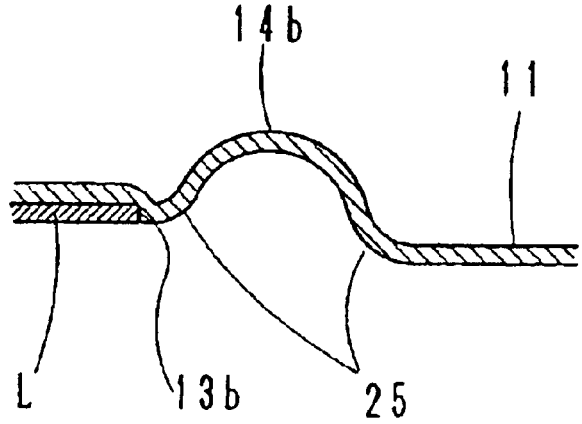
FIG. 4 is a cross section view of the rib according to the other embodiment.

In the embodiment illustrated in FIG. 3, a label surface coincides with a wall surface of the body. However, a wall portion at which the label is not attached may be protruded compared to a wall portion at which the label is attached, as illustrated in FIG. 4.

Figure 5:
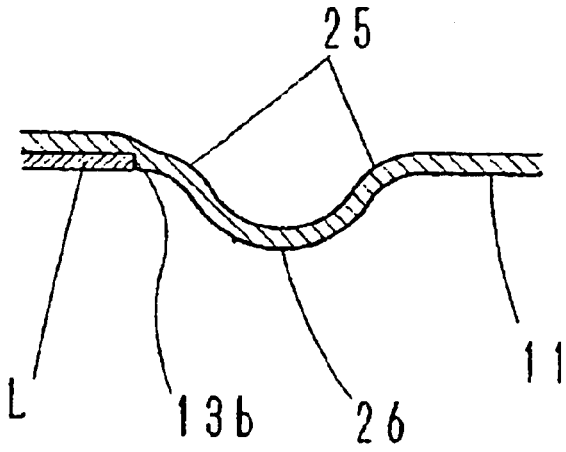
FIG. 5 is a cross section view of the convex rib according to the further other embodiment.
Figure 6:
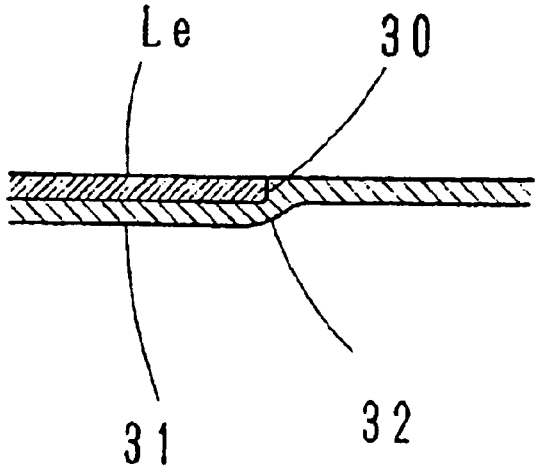
FIG. 6 is a cross section view of the label attached portion of the conventional container.

Although the vertical rib 14 is concaved in the above described embodiment, it may be a convex rib 26 as illustrated in FIG. 5.

According to these modified examples, since the impact is relieved due to the deformation of the curved portion 25 arranged at both sides of the vertical rib 14, these modified examples provides same advantages as described above.

The second embodiment of the present invention will be described hereinafter referring to drawings.

In the above described first embodiment, the vertical ribs are arranged respectively along left and right edges of the label. On the other hand, in the second embodiment, vertical ribs and lateral ribs are disposed to surround full peripheral circumference of label edge. In the following explanation, relating to components of the second embodiment same as those of the first embodiment, suffix "a" is attached to respective numerals, to prevent the repeat of the explanation. The differences between the first and the second embodiments will be described mainly hereinafter.

Figure 7:
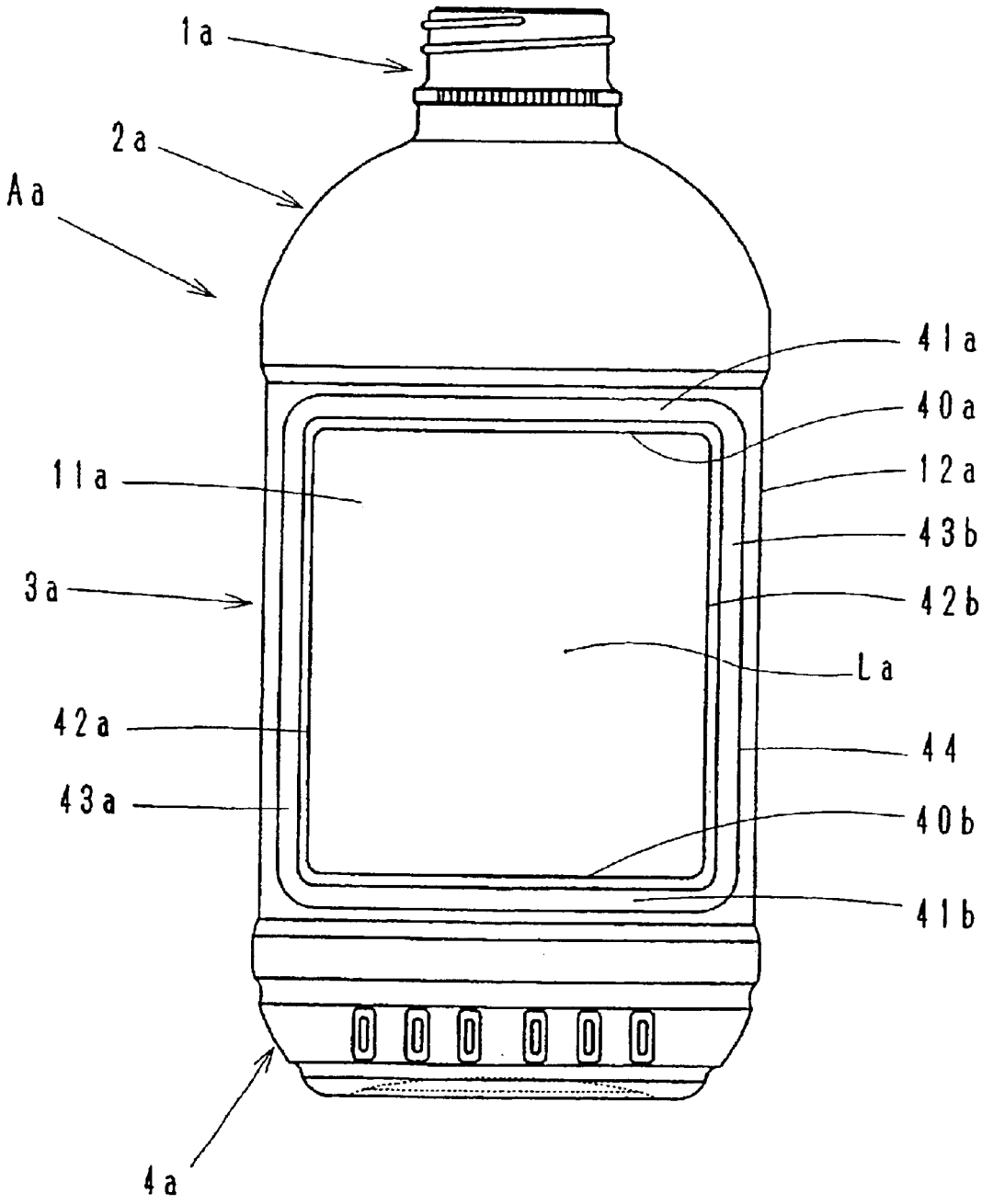
FIG. 7 is a front view of the synthetic resin container according to the second embodiment of the present invention.

In FIG. 7, a synthetic resin container "Aa" comprises a neck 1*a*, a shoulder 2*a*, a body 3*a* and a bottom 4*a*.

The body 3*a* comprises front and rear walls 11*a*, and left and right side walls 12*a*.

Each of the front and rear walls 11*a* is provided with lateral ribs 41*a*, 41*b* along upper and lower edges 40*a*, 40*b* of a label "La", respectively, and with vertical ribs 43*a*, 43*b* along left and right edges 42*a*, 42*b* of the label "La".

The lateral ribs 41*a*, 41*b* and the vertical ribs 43*a*, 43*b* are connected with one another to surround the label.

As well as the first embodiment, each of the side walls 12*a* is provided with a plurality of concave portions.

The container of the second embodiment can be formed by a method similar to that of the first embodiment. A die has an inner surface for forming the container, which surface has protruded portions, which will form the lateral ribs 41 and the vertical ribs 43 of the container. First, the label "La" is arranged in the die such that the label is surrounded by the protruded portions. Then, a parison is extruded, hold by the dies, and is blow-molded.

The function and the effect of the second embodiment of the present invention will be described.

Even if the container is dropped, curved portions 44 at both sides of each of the lateral and vertical ribs 41, 43 are bended and deformed, so as to relieve the impact of dropping, to prevent crack at edges 40, 42 of the label.

According to the second embodiment, it is not necessary to make the upper and lower ends of the label close to the steps provided above and below the body. Thus, the size of the label can be freely changed.

Moreover in case of the thin container, the lateral rib 41 and the vertical rib 43 of the body wall act as reinforcement for the wall, keep a shape or appearance of the container, and prevent crack at the label edge due to the dropping impact of the container.

The third embodiment of the present invention will be described by referring to the accompanied drawings.

In this embodiment, the label edge is located in or reaches to the rib. In the following explanation, relating to components of the third embodiment same as those of the first embodiment, suffix "b" is attached to respective numerals, to prevent the repeat of the explanation. The differences will be described mainly hereinafter.

Figure 8:
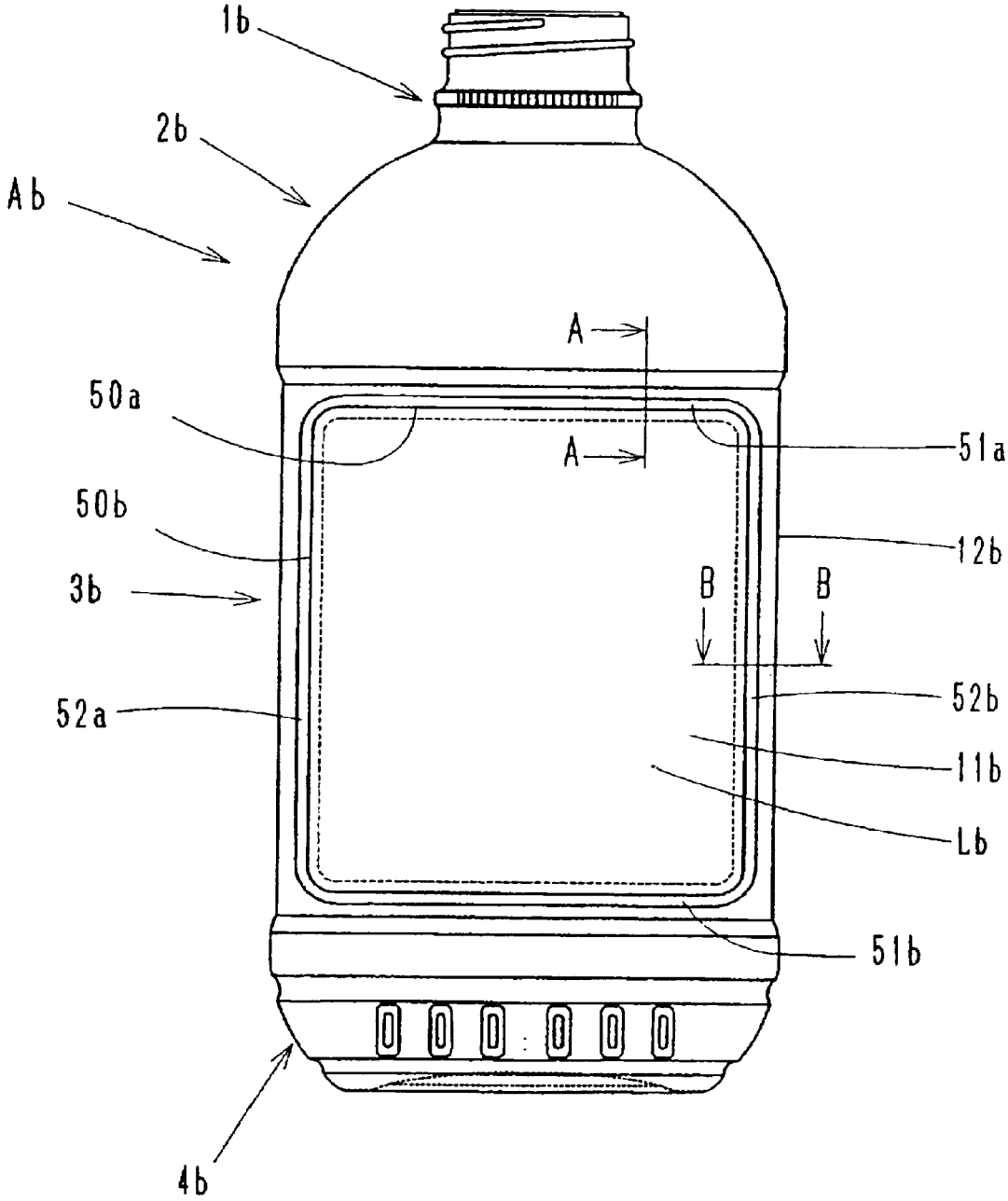
FIG. 8 is a front view of the synthetic resin container according to the third embodiment of the present invention.
Figure 9:
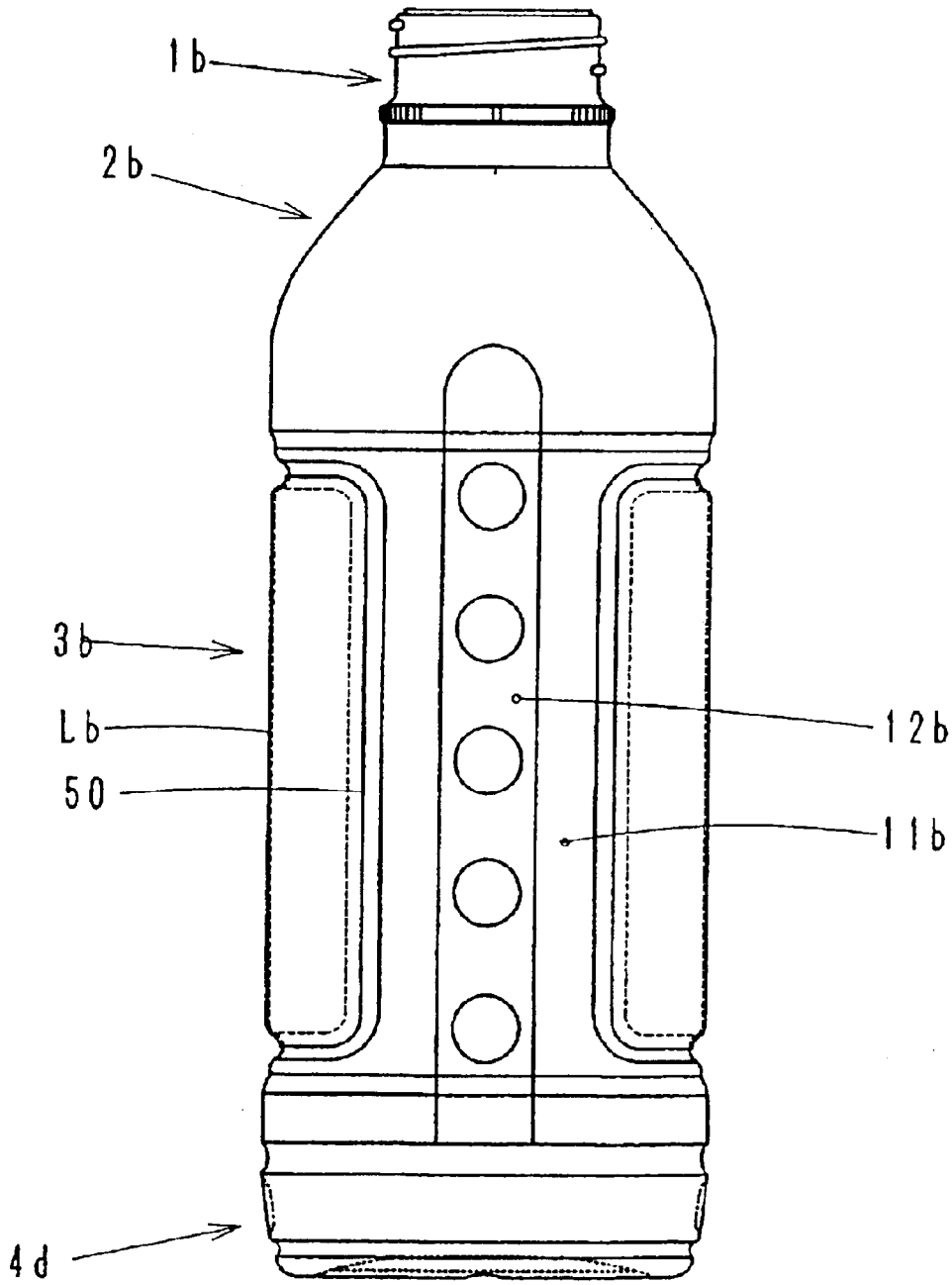
FIG. 9 is a side view of the container illustrated in FIG. 8.

In FIGS. 8 and 9, a container "Ab" made of synthetic resin comprises a neck 1*b*, a shoulder 2*b*, a body 3*b* and a bottom 4*b*.

The body 3*b* comprises front and rear walls 11*b*, and left and right side walls 12*b*. The body 3*b* has a flattened cross section, which comprises elliptical front and rear surfaces of front and rear walls 11*b*, and planar side surfaces of left and right side walls 12*b*.

Each of the front and rear walls 11*b* is provided with lateral ribs 51*a*, 51*b* along upper and lower edges 50*a* of a label "Lb", and with vertical ribs 52*a*, 52*b* along right and left edges 50*b* of the label "Lb". Each of the side walls 12 is provided with a plurality of concave portions arranged with equal intervals one another.

The container according to this embodiment is formed by a well-known "label-in-mold" method.

A die has an inner surface for forming the container, which surface has protruded portions for forming the lateral ribs 51 and the vertical ribs 52 of the container. First, the label "Lb" is arranged in the die such that the label edge is located along a central line of each of the protruded portions. Then, a parison is extruded, hold by the dies, and is blow-molded.

The function and effect of the third embodiment will be described hereinafter.

Figure 10:
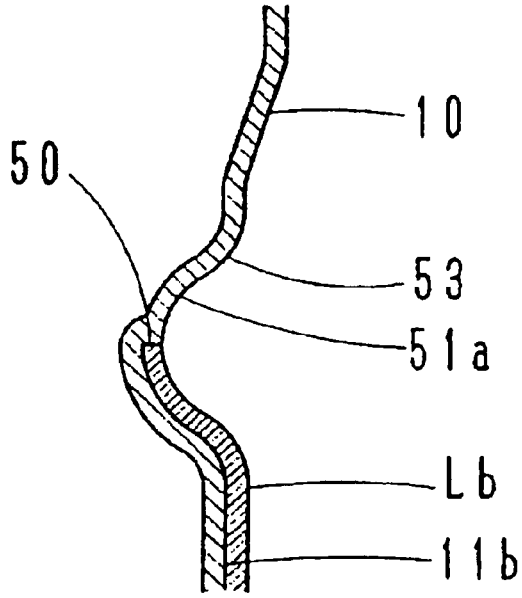
FIG. 10, (a) is a cross section view of the lateral rib along line A—A of FIG. 8 and (b) is a cross section view of the vertical rib along line B—B of FIG. 8.
Figure 10:
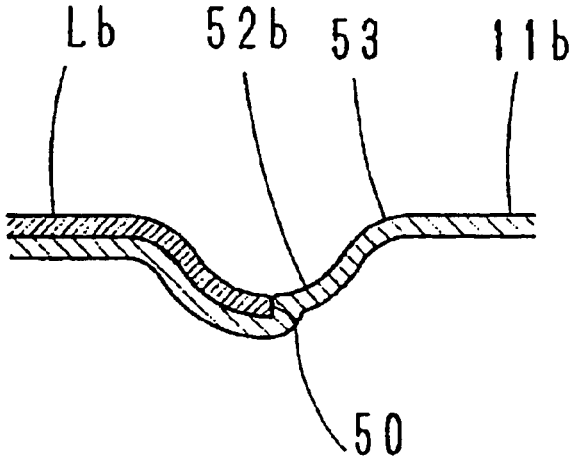

As illustrated in FIG. 10, each of four edges 50 of the label "Lb" is arranged to locate within lateral ribs 51*a*, 51*b* or vertical ribs 52*a*, 52*b*.

Although the body wall portion at the rib contacting with the edge of the label is thinner than other parts of the container, when the container is dropped, since curved portions 53 of the lateral rib 51 and the vertical rib 52 at a side that the label is not attached are deformed, an impact to the thin wall along the edges 50 of the label is relieved, so as to prevent crack at edges of the label.

With reference to the thickness of the container, if the container is made of PE or PP and if the body wall is formed to be thin about 0.6 mm, the crack would occur at the edge of the body according to the conventional art. However, in such case, the present invention prevents the crack.

In case of the thin container, if the body wall at the center of the front or rear wall has a thickness about 0.3 mm or less, such container can be easily crushed to dispose it.

The lateral rib 51 and the vertical rib 52 act as reinforcing member, respectively, so as to keep the shape of the container. In addition, they prevent crack of the container wall at edge of the label, even if the container is dropped.

Figure 11:
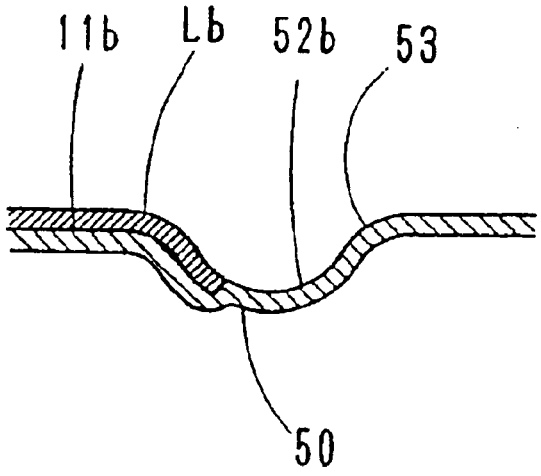
FIG. 11 is a cross section view of the rib according to the other embodiment.

In the embodiment as illustrated in FIG. 10, the label is arranged such that the edge 50 of the label "Lb" is located on the central line of the rib 51, 52. As illustrated in FIG. 11, the edge 50 of the label "Lb" may be shifted from the center line to arrange the label. In this case, curved portions 53 of each of the ribs 51, 52 at a side that the label is not attached are deformed, so that an impact to the thin wall along the edges 50 of the label is relieved, in other words, such modification has function and effect same as those as described above.

Figure 12:
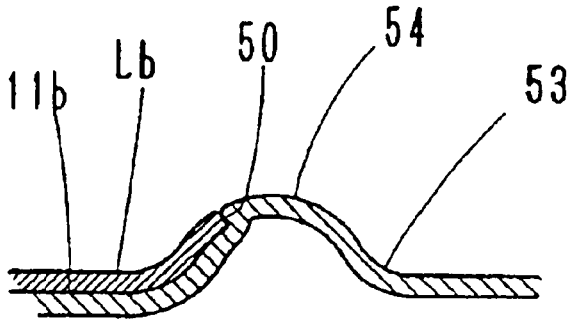
FIG. 12 is a cross section view of the convex rib.

In the above described embodiment, the lateral rib 51 and the vertical rib 52 are concaved. They may be a convex rib 54 as illustrated in FIG. 12. In this case, the die for forming the container is provided with recesses for forming these convex ribs, and each of the edges of the label "Lb" is arranged to locate within each of the recesses. These convex ribs have function and effect same as those of the concaved ribs 51 and 52.

The fourth embodiment of the present invention will be described in conjunction with accompanied drawings.

In this embodiment, an edge the label of aforementioned embodiments is modified to a corrugated or waved shape, and a flat bottom concave portion is provided on the body wall to locate the edge of the label therein. Relating to components of the second embodiment same as those of the first embodiment, suffix "c" is attached to respective numerals, to prevent the repeat of the explanation. The differences between the first and the second embodiments will be described mainly hereinafter.

Figure 13:
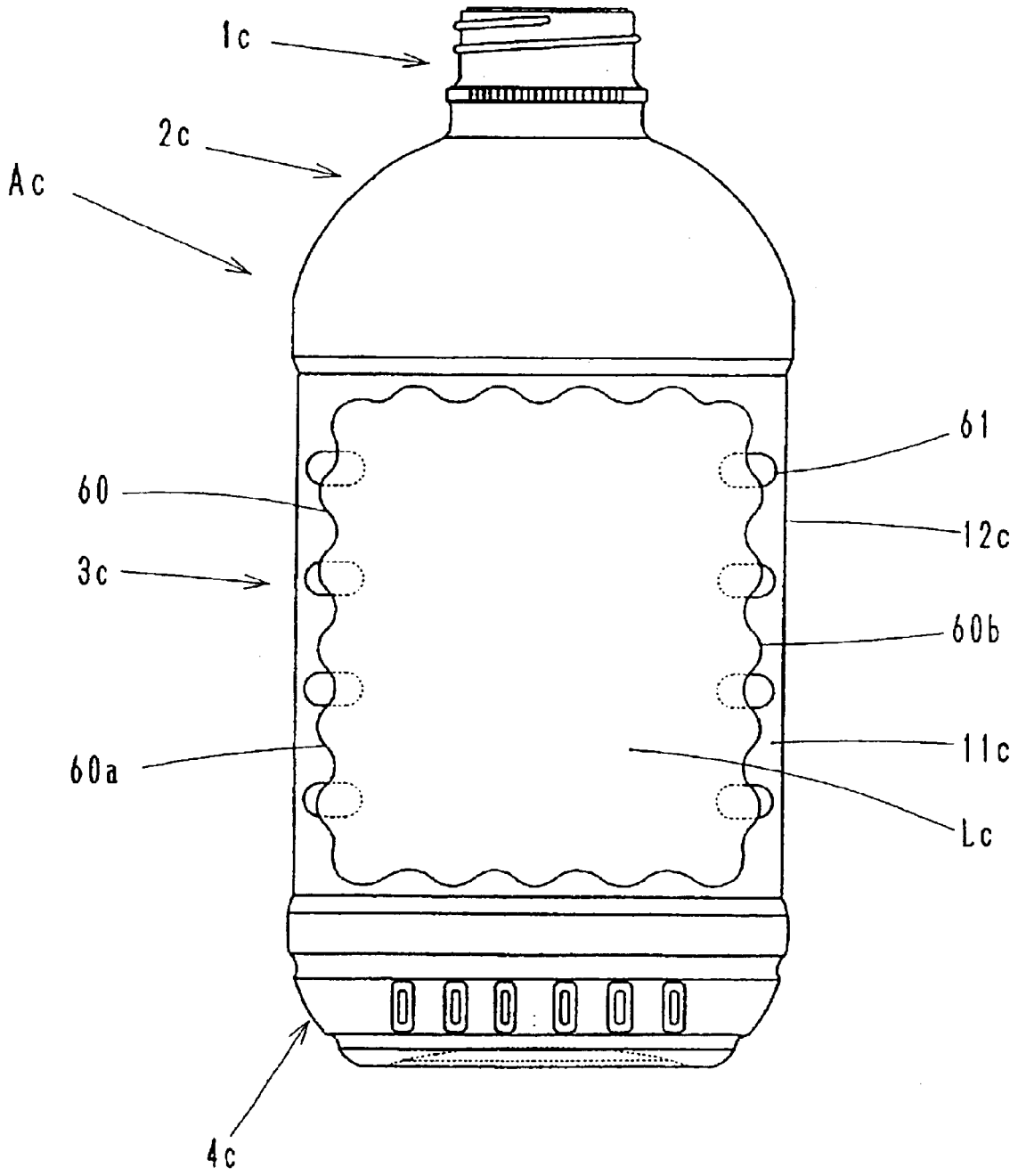
FIG. 13 is a front view of the synthetic resin container according to the fourth embodiment.
Figure 14:
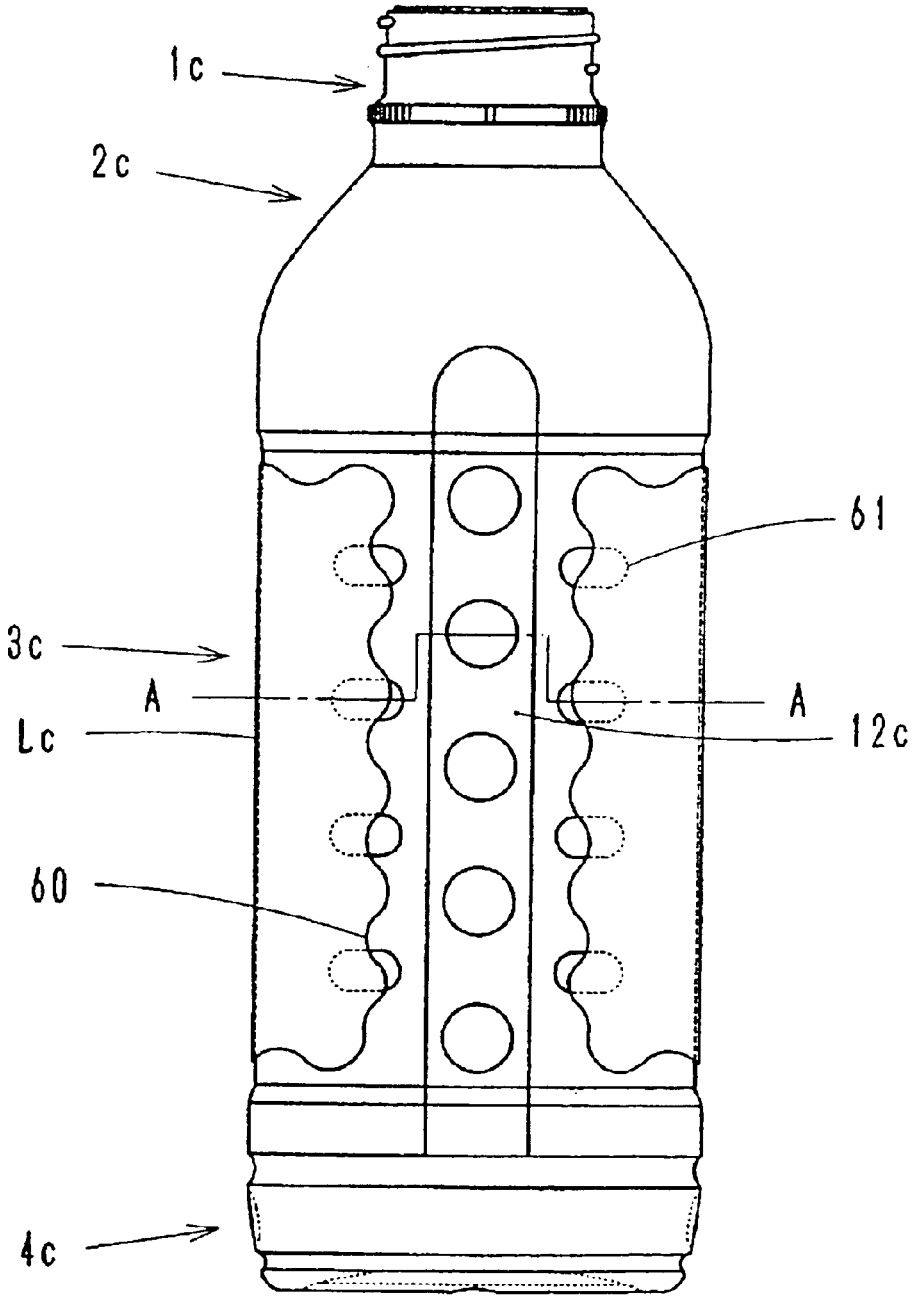
FIG. 14 is a side view of the container illustrated in FIG. 13.
Figure 15:
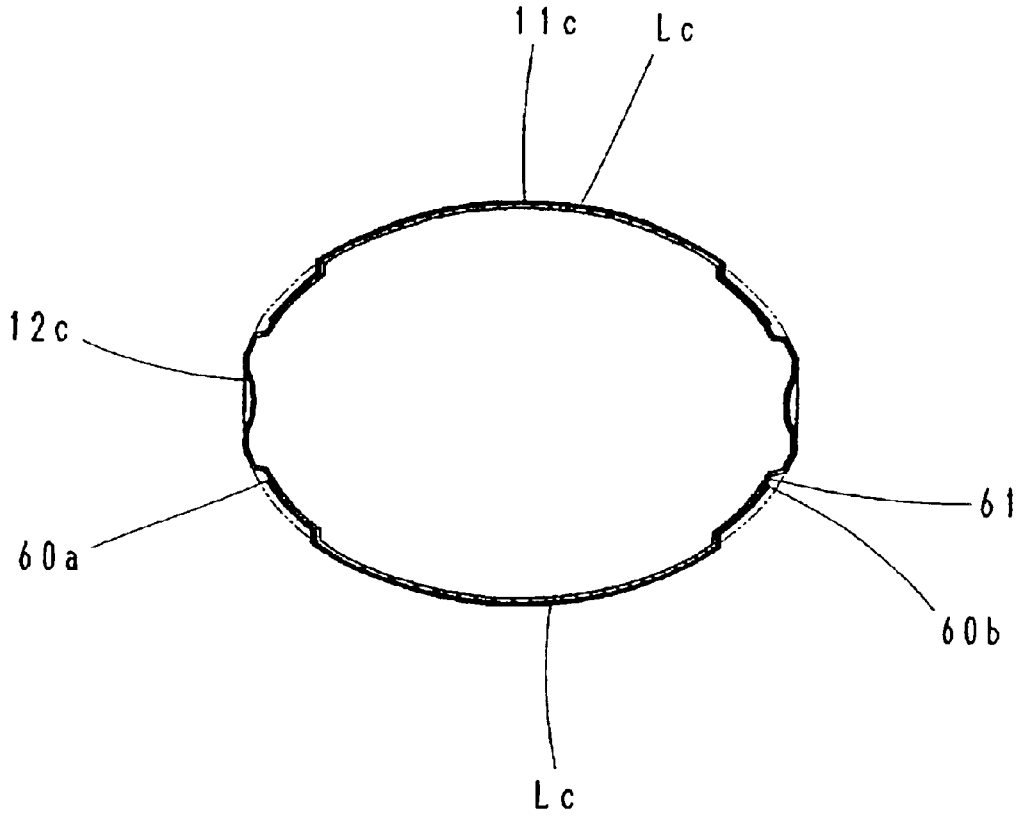
FIG. 15 is a cross section view of the flat bottom concave portion along the line A—A of FIG. 14.

In FIG. 13, a container "Ac" molded by a direct blow molding comprises a neck 1*c*, a shoulder 2*c*, a body 3*c* and a bottom 4*c*.

The body 3*c* comprises front and rear walls 11*c*, and left and right side walls 12*c*.

The body 3*c* has a flattened cross section, which comprises elliptical front and rear surfaces of front and rear walls 11*c*, and a planar side surfaces of left and right side walls 12*c*. Each of the front and rear walls 11*c* is attached with a label "Lc" having a corrugate shaped edge.

The label "Lc" is an in-mold label which edge 60 is cut to be corrugate shape in the peripheral circumference. The label is substantially square shape.

A width and a height of each corrugate is determined adequately in view of the size, the thickness and the like of the body wall of the container.

Each of the front and rear walls 11*c* is provided with a plurality of flat bottom concave portions 61 along left and right edges 60*a*, 60*b* of the label "Lc". Each of the flat bottom concave portions 61 has a shallow bottom.

The flat bottom concave portions 61 are located in vertical direction with equal intervals one another. Each of the flat bottom concave portions 61 has an oval shape. Each of the oval shaped concave portions laterally extends to cover a top and a bottom of the corrugate or wave of the label edges 60*a*, 60*b*, and the edges 60*a*, 60*b* of the label "Lc" are located within the bottom of the flat bottom concave portion 61.

With reference to a method for molding the container, the container of the present invention is molded by a direct blow molding, and the conventional "label-in-mold" method is used.

First, the label "Lc" is disposed in a die such that the edge of label "Lc" is positioned in protruded portion for forming the body of the container.

Then, a parison is extruded, hold by the dies, and is blow-molded by blowing air, to form the container attached with the label on the body.

The function and the effect of the fourth embodiment of the container will be described hereinafter.

Since the label "Lc" is attached to the container by the in-mold method, the body wall portion contacting with a corner of the edge 60 of label "Lc" is thinner than other parts of the container, like the conventional container. However, such thin portion is formed in corrugate shape along the label edge, so as to prevent crack. When the container is dropped, a stress such as a tension, a compression and a shearing is concentrated to the thin portion, to cause a plasticity deformation thereon, so as to occur crack. According to this embodiment, since the thin portion is bent to a corrugate shape, strength of the stress is different in each portion of the corrugate or wave shape. Even if a plasticity deformation occurs at a portion at which the stress is concentrated, the plasticity deformation does not increase or is not diffused, because such deformation is not transmitted by the curved portion, so as to prevent the crack.

Since the flat bottom concave portion 61 is arranged along the label edge 60, the concave portion 61 acts as reinforcement, so as to prevent the crack along the label edge 60.

Therefore, this embodiment effectively prevents the cracking in case of dropping the container, by the corrugate shape of the edge of the in-mold label together with the flat bottom concave portion.

In case of a thin container, even if the body wall at the center of the front and rear wall has a thickness about 0.3 mm or less, the container keeps its shape or appearance due to the reinforcements of the body and the bottom, and also can be easily crushed by hand to dispose it, like the first embodiment.

In the above described embodiment, the whole peripheral circumference of the label edge 60 is formed in a corrugate shape. Only the left and right edges 60*a*, 60*b* may be formed in corrugate shape and the upper and lower edges may be straight line, because the upper and lower portions of the body at which the upper and lower edges of the label are positioned are reinforced by the steps just above and below the body.

With respect to the shape of the corrugation, the width and the height of the corrugation or wave can be determined adequately or freely as described above. The shape thereof such as a sine curve, a succession of an arch or an oval arch, a succession of arranging the arch or the oval arch on a top of the corrugation, a zigzag type and the like may be applied.

In the above described embodiment, the concave portion arranged on the body wall has the flat bottom. The concave portion may have a bottom of the bending surface. The shape of the concave portion may be a circular shape, an oval shape or a square shape having an arch shape corner.

The concave portion may be omitted, if the wall of the container has sufficient thickness, or if the body is provided with laterally extended concave grooves so that the body has a corrugated wall.

The fifth embodiment of the present invention will be described by referring to accompanied drawings.

In this embodiment, a portion of the wall where the edge of the label is located is formed to be thick. In the following explanation, relating to components of the fifth embodiment same as those of the first embodiment, suffix "d" is attached to respective numerals, to prevent the repeat of the explanation. The differences between the first and the second embodiments will be described mainly hereinafter.

Figure 16:
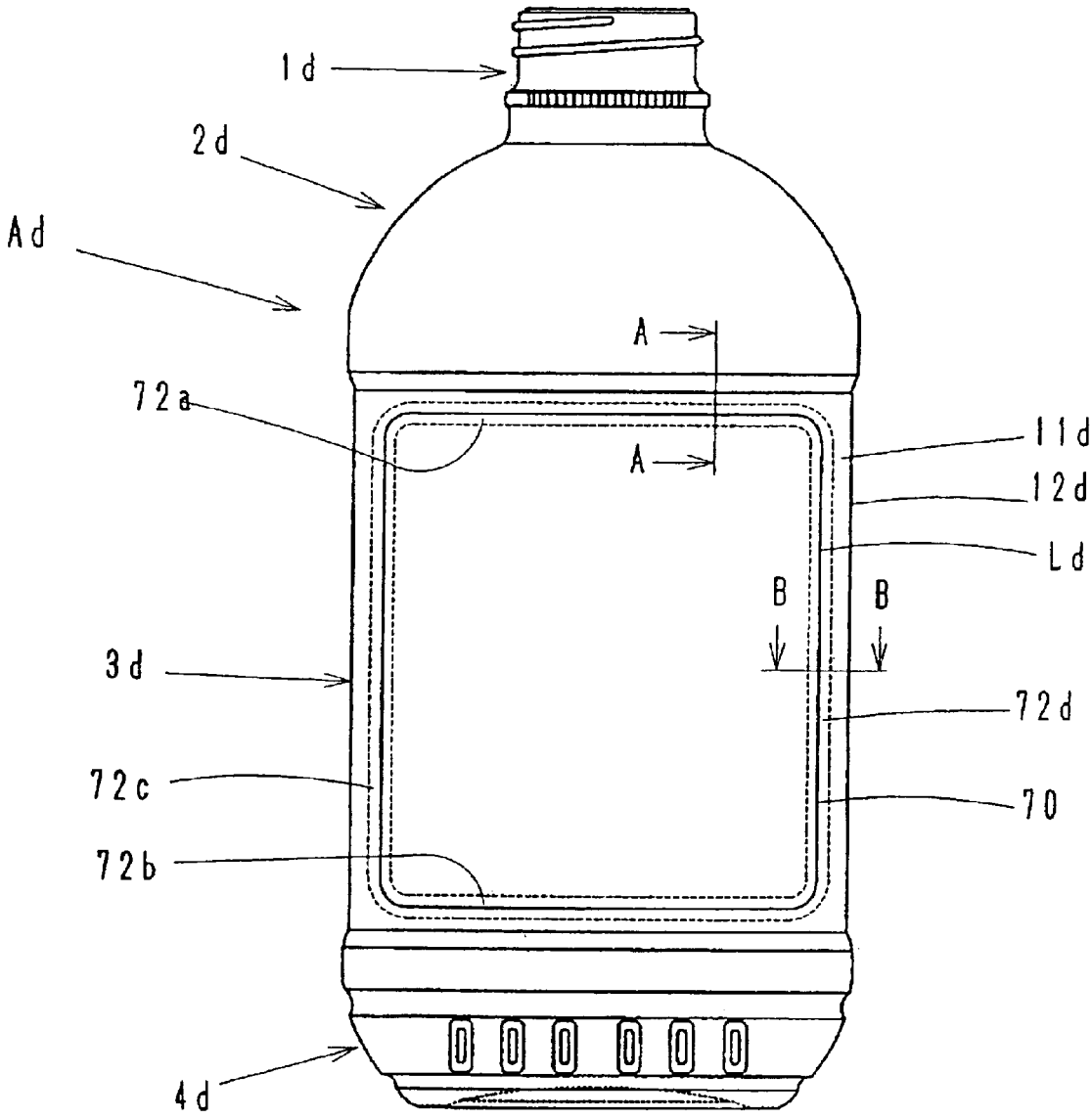
FIG. 16 is a front view of the synthetic resin container according to the fifth embodiment.
Figure 17:
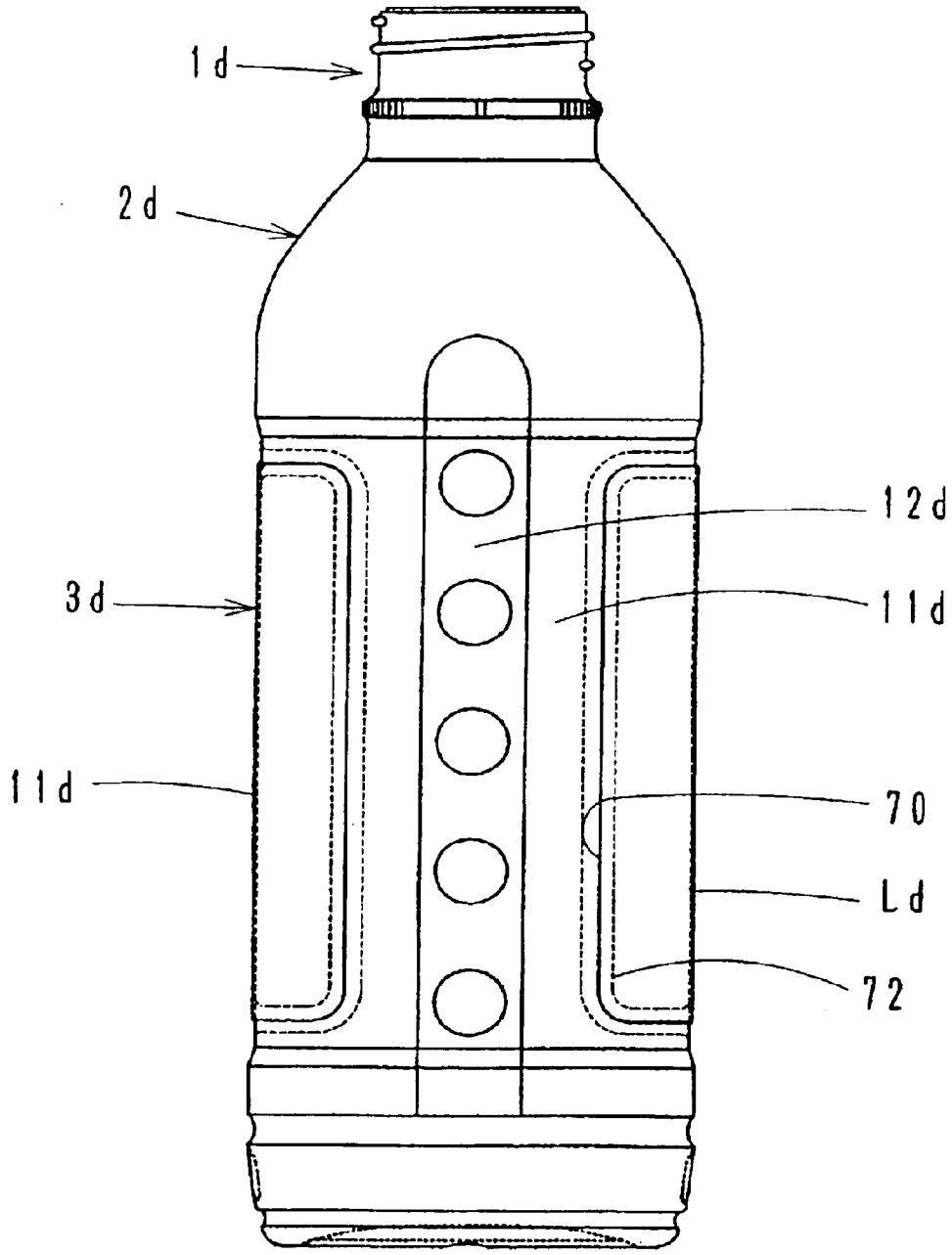
FIG. 17 is a side view of the container illustrated in FIG. 16.

In FIGS. 16 and 17, a container "Ad" molded by a direct blow molding comprises a neck 1*d*, a shoulder 2*d*, a body 3*d* and a bottom 4*d*.

The body 3*d* comprises front and rear walls 11*d*, and left and right side walls 12*d*.

The body 3*d* has a flattened cross section, which comprises elliptical front and rear surfaces of front and rear walls 11*d*, and a planar side surfaces of left and right side walls 12*d*.

Figure 18:
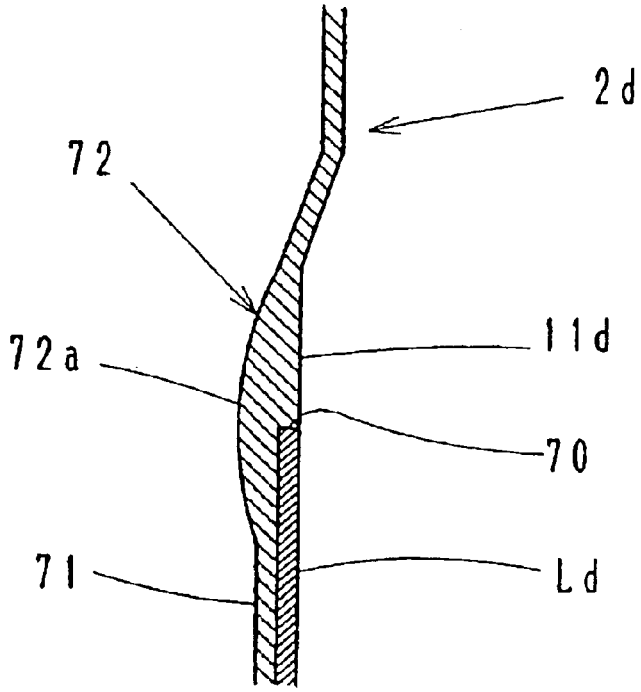
FIG. 18, (a) is a cross section view of the lateral rib along line A—A of FIG. 16 and (b) is a cross section view of the vertical rib along line B—B of FIG. 1.
Figure 18:
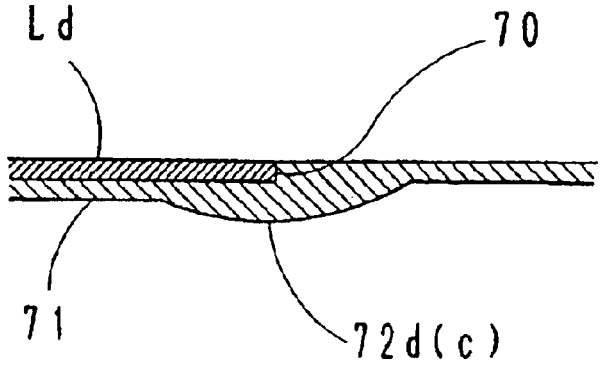

Each of the front and rear walls 11*d* is attached with a square shaped label "Ld". Each of the front and rear walls 11*d* is formed on an inner surface 71 thereof with thick portions 72 where edges 70 of the label "Ld" is located at a center of each of the thick portions, as illustrated in FIG. 18.

The thick portions 72 comprise thick portions 72*a*, 72*b* extending laterally and corresponding to the upper and lower edges of the label "Ld", and thick portions 72*c*, 72*d* extending vertically and corresponding to the right and left edges of the label "Ld".

The container of this embodiment is formed by a direct blow molding, and the conventional method of a label-in-mold is used.

First, the label "Ld" is arranged on a predetermined position of an surface of a die for forming the body of the container.

Then, a parison is extruded, hold by the die, and blow-molded to the container with label by blowing air into the parison.

For extruding the parison, a parison controller is used for controlling the thickness along the peripheral direction. The parison is extruded such that a portion of the parison to be formed to the body wall attached with the lower edge of the label is formed to be thick in a range corresponding to the width of the label, then such that narrow portions of the parison to be formed to the body wall attached with the right and left edges of the label are formed to be thick in a range corresponding to the height of the label, and finally such that a portion of the parison to be formed to the body wall attached with the upper edge of the label is formed to be thick in a range corresponding to the width of the label.

Consequently, obtained is the container having a thick portion 72 at the inner surface 71 of the body, said thick portion contacting with the edge 70 of the label.

The thick portion contacting with the label edge has 1.1 to 3.0 times as thickness as the other portions.

The function and the effect of the fifth embodiment of the synthetic resin container will be described.

As illustrated in FIG. 18, the inner surface 71 of the body where the edge 70 of the label "Ld" is located is formed to be the thick portion 72 thicker than the other parts. The thick portion 72 acts as reinforcement to keep the shape or appearance of the container, and to prevent the crack at the label edge due to the impact of dropping the container.

This fifth embodiment of the present invention can be applied not only for a single layered container but also for layered one.

For forming such container, a layered parison is extruded by a parison controller in controlling the thickness to be blow molded to the container having a thick portion where the label edge is contacted, as well as the single layered container.

INDUSTRIAL APPLICABILITY OF THE INVENTION

As described hereinbefore, in a synthetic resin container of the present invention, the wall surface of the container body corresponding to the edge of the in-mold-label is reinforced so as to be useful for the synthetic resin container which the in-mold-label is arranged, especially useful for a thin synthetic resin container capable of being crushed.

What is claimed is:

1. A synthetic resin container, comprising:

a neck;

a bottom;

a body positioned between the neck and the bottom, the body including an in-molded label having left and right edges;

a thick portion formed on an inner surface of the body which is adjacent to and under the edges of the label; and a vertical, curved rib extending along the left and right edges of the label, wherein the vertical, curved rib is contiguous with the left and right edges of the label.

2. A synthetic resin container, comprising:

a neck;

a bottom;

a body positioned between the neck and the bottom, the body having upper, lower, left and right portions and including an in-molded label;

a thick portion formed on an inner surface of the body which is adjacent to and under an edge of the label; and lateral, curved ribs extending along the upper and lower portions, and vertical, curved ribs extending along the left and right portions of the body.

3. A synthetic resin container, comprising:

a neck;

a bottom;

a body positioned between the neck and the bottom, the body having an in-molded label having edges;

a thick portion formed on an inner surface of the body which is adjacent to and under the edges of the label; and a lateral, curved rib and at least a vertical, curved rib extending along the edges of the label, wherein the edges of the label are positioned in the ribs.

4. A wall of a synthetic resin container, comprising:

a wall surface;

a label having left and right edges, the label formed into the wall surface by an in-mold; and a thick portion formed on an inner surface of the wall surface which is adjacent to and under the edges of the label, wherein the left and right edges having a recessed, corrugate shape formed in the wall surface.

5. A synthetic resin container, comprising:

a neck;

a bottom;

a body positioned between the neck and the bottom, the body including an in-molded label having corrugate shaped edges; and a thick portion formed on an inner surface of the body which is adjacent to and under the edges of the label, wherein the body is provided with a plurality of recessed, concave portions disposed along left and right edges of the label with equal intervals in a vertical direction, positioning the edges of the label in said concave portions.

6. A synthetic resin container, comprising:

a neck;

a bottom; and a body positioned between the neck and the bottom, the body including an in-molded label, wherein a thick portion is formed on an inner surface of the body adjacent to and under an edge of the label, and the thick portion is not formed under the entire label, and the thick portion spans at least the edge of the label.

* * * * *